US010209014B2

(12) United States Patent
Kühbauch et al.

(10) Patent No.: US 10,209,014 B2
(45) Date of Patent: Feb. 19, 2019

(54) BRAZED HEAT EXCHANGER

(71) Applicant: Modine Manufacturing Company, Racine, WI (US)

(72) Inventors: Daniel Kühbauch, Mühlacker (DE); Jürgen Zeitlinger, Reutlingen (DE)

(73) Assignee: Modine Manufacturing Company, Racine, WI (US)

( * ) Notice: Subject to any disclaimer, the term of this patent is extended or adjusted under 35 U.S.C. 154(b) by 498 days.

(21) Appl. No.: 14/619,162

(22) Filed: Feb. 11, 2015

(65) Prior Publication Data

US 2015/0233653 A1 Aug. 20, 2015

(30) Foreign Application Priority Data

Feb. 20, 2014 (DE) ..... 10 2014 002 407

(51) Int. Cl.

| | |
|---|---|
| ***F25B 39/04*** | (2006.01) |
| ***F28F 9/02*** | (2006.01) |
| ***F28F 1/02*** | (2006.01) |
| ***F28D 1/053*** | (2006.01) |
| ***F28F 1/06*** | (2006.01) |
| ***F28F 1/08*** | (2006.01) |

(52) U.S. Cl.

CPC ..... *F28F 9/02* (2013.01); *F25B 39/04* (2013.01); *F28D 1/05366* (2013.01); *F28F 1/02* (2013.01); *F28F 1/06* (2013.01); *F28F 1/08* (2013.01); *F28F 9/0243* (2013.01); *F28F 9/0251* (2013.01); *F28F 2275/04* (2013.01)

(58) Field of Classification Search

CPC ..... F25B 39/04; F25B 2339/044; F28F 2009/0292

USPC ..... 165/132; 62/509

See application file for complete search history.

(56) References Cited

U.S. PATENT DOCUMENTS

| | | | | |
|---|---|---|---|---|
| 3,326,283 | A | 6/1967 | Ware | |
| 3,901,430 | A * | 8/1975 | McLain | B21C 37/0803 228/146 |
| 5,709,106 | A * | 1/1998 | Inaba et al. | B60H 1/3227 62/507 |
| 5,884,503 | A * | 3/1999 | Inaba | F25B 39/04 62/509 |
| 5,946,940 | A | 9/1999 | Inoue | |

(Continued)

FOREIGN PATENT DOCUMENTS

| | | |
|---|---|---|
| EP | 1147930 | 10/2001 |
| EP | 1505358 A2 | 2/2005 |

(Continued)

OTHER PUBLICATIONS

Chinese Patent Office Action for Application No. 201510086875.2 dated Jul. 2, 2018 (17 pages, English translation included).

Japanese Patent Office Action for Application No. 2015-031469 dated Jun. 18, 2018 (12 pages, English translation included).

*Primary Examiner* — Allen Flanigan

(74) *Attorney, Agent, or Firm* — Michael Best & Friedrich LLP; Jeroen Valensa; Michael Bergnach

(57) ABSTRACT

A brazed heat exchanger, having a block consisting of flat tubes and fins, having header tubes arranged at opposite ends of the flat tubes and having an additional tube, which is connected to one of the header tubes. To reduce brazing defects, provision is made for at least a significant part of an outer surface of the additional tube and/or of the header tubes to be of enlarged design.

19 Claims, 6 Drawing Sheets

(56) References Cited

U.S. PATENT DOCUMENTS

| | | | | |
|---|---|---|---|---|
| 6,154,960 | A * | 12/2000 | Baldantoni et al. | F28F 1/16 165/178 |
| 7,093,461 | B2 * | 8/2006 | Patel et al. | F25B 39/04 62/509 |
| 7,131,293 | B2 * | 11/2006 | Filipiak et al. | F25B 39/04 62/509 |
| 2003/0111459 | A1 | 6/2003 | Nishimura | |
| 2004/0007012 | A1 * | 1/2004 | Lee et al. | B23P 15/26 62/474 |
| 2006/0162375 | A1 * | 7/2006 | Forster et al. | F25B 39/04 62/509 |
| 2007/0044505 | A1 * | 3/2007 | Kaspar et al. | F25B 39/04 62/509 |
| 2008/0128120 | A1 * | 6/2008 | Wang | B23P 15/26 165/104.33 |
| 2008/0156012 | A1 | 7/2008 | Feldhaus et al. | |
| 2013/0312441 | A1 | 11/2013 | Fritz | |

FOREIGN PATENT DOCUMENTS

| | | | |
|---|---|---|---|
| EP | 1921411 | A1 | 5/2008 |
| EP | 2287552 | A1 | 2/2011 |
| JP | H09-217967 | A | 8/1997 |
| JP | H09-310936 | A | 12/1997 |
| JP | H09-329372 | A | 12/1997 |
| JP | 2004061076 | A | 2/2004 |
| JP | 2004309127 | A | 11/2004 |
| KR | 100692996 | B1 | 3/2007 |

* cited by examiner

BRAZED HEAT EXCHANGER

CROSS-REFERENCE TO RELATED APPLICATIONS

This application claims priority to German Patent Application No. DE 10 2014 002407.5, filed Feb. 20, 2014, the entire contents of which are hereby incorporated by reference herein.

FIELD OF THE INVENTION

The invention relates to a brazed heat exchanger, having a block consisting of flat tubes and fins, having header tubes at opposite ends of the flat tubes and having an additional tube, which is connected to one of the header tubes.

BACKGROUND

A brazed heat exchanger, which is a condenser that forms one component of an air-conditioning system and cyclically condenses a circulating refrigerant, e.g. by means of a cooling air flow, is known from European Patent Publication EP 1 147 930 B1 and from numerous other publications.

Brazing is usually carried out in a brazing furnace, into which the heat exchanger described at the outset is introduced after appropriate preassembly and pretreatment and is generally produced in a single brazing operation. This means that all the connections are brazed in a single brazing operation.

There are often problems with brazing. The causes thereof are many and various and are often difficult to determine. They can be roughly divided into causes of a procedural kind and those of a product-specific kind and, where applicable, those which represent a mixture of the two kinds.

In respect of the product (heat exchanger) described at the outset, causes of a product-specific kind will be explored only briefly here. These include material-related and design-related causes, e.g. impermissible air gaps or the like.

One specific cause of a product-specific kind sometimes resides in the fact that the above-denoted components of the brazed heat exchanger have different masses, for which reason it is not possible to bring all the components simultaneously to the brazing temperature. For example, the very thin-walled flat tubes and fins reach the brazing temperature more quickly than the header tubes and the additional tube, which have thicker walls. This can result in brazing defects which lead to leaks in the heat exchanger or which at least facilitate corrosive effects during the intended use of the heat exchanger.

Baffles which direct hot gas onto the components with a greater mass in order to accelerate the heating thereof and thus bring all the components to the brazing temperature simultaneously as far as possible have been installed in the brazing furnace in the prior art in order to solve the problems (e.g., U.S. Patent Application Publication No. US 2003/0111459A, inter alia). As regards such measures and similar measures, it may be mentioned as a disadvantage that there is a desire to braze products of different designs in the brazing furnace, requiring baffles matched to the different products and thereby giving rise to considerable expenditure.

SUMMARY

An object of the invention consists in a quality improvement or reduction in brazing defects.

The solution according to one embodiment of the invention is obtained, in the case of the brazed heat exchanger by virtue of the fact that at least a significant part of an outer surface of the additional tube is of enlarged design, being grooved or profiled in some other way for example. In one embodiment, a significant part of the outer surface of the tube being grooved or profiled means at least a majority of the length of the tube includes the grooved or profiled surface.

The inner surface of the additional tube preferably remains smooth, i.e. is not grooved or profiled, and is also not designed in the manner of a corrugated tube, since this could be somewhat more disadvantageous as regards the often-desired sealing at the wall in the additional tube with respect to the circumference of a dryer cage or the like.

It can be expedient for the header tubes too to be designed with an enlarged outer surface. Fittings or other functional parts of the heat exchanger can also be provided with an enlarged surface, in particular an enlarged outer surface.

In the meantime, it has been confirmed by tests that the enlarged surface of the additional tube leads to a more rapid temperature rise of the additional tube in a brazing furnace. This alone may not be very surprising. What is surprising, however, is the rapidity of the temperature rise, which is namely so great that brazing defects in the heat exchanger are at least reduced, as the tests have shown.

Improved shrinkage behavior, especially of the additional tube in the assembly with a header tube, has also been observed in the course of the cooling process of the heat exchanger which starts after brazing, i.e. the shrinkage dimensions have become smaller. A contribution to the quality improvement is also made by this means because tighter tolerances can be maintained. The improved shrinkage behavior is attributed to the fact that the heat exchanger according to the invention has temperature differences between the component parts (components) thereof in the relevant brazing temperature range (about 600° C.) which are about 2-3 times lower than a heat exchanger not in accordance with an embodiment of the invention.

It has furthermore become possible to reduce the weight of the additional tube without excessively impairing the strength thereof. For the same wall thickness of the additional tube as an additional tube from the prior art, the weight reduction is obtained, for example, by means of a grooved design on the outer surface thereof.

Tubes for heat exchangers with an enlarged surface have long been known. The enlarged surface is generally the inner surface of the tube (e.g. German Published Patent Application No. 1 501 656). Such tubes are used on a regular basis in the prior art to raise the heat transfer coefficient, i.e. the efficiency of heat exchange, by producing turbulence or suppressing laminar wall flows.

It was not obvious to a person skilled in the art dealing with brazing methods to improve the brazing quality of heat exchangers through the use of an externally grooved additional tube because the currently available prior art contains no indication to make it obvious. A person skilled in the art responsible for the design of brazed heat exchangers had no reason to propose a heat exchanger which would be more complex through the provision of the enlarged surface because said person could not expect that this additional effort would bring advantages to justify it.

As a positive side effect, it is possible to attribute to the solution according to the invention an improvement—if only slight—in the heat exchange efficiency of the heat exchanger since, for example, a cooling air flow flowing through the fins often also flows along the additional tube and, owing to the enlarged outer surface thereof, can better develop its cooling effect on the refrigerant, for example, which is situated therein. In other words, it can be stated that this proposal has made of the additional tube a tube with better heat exchange properties, at least in some applications.

The invention is described below in illustrative embodiments by means of the attached drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
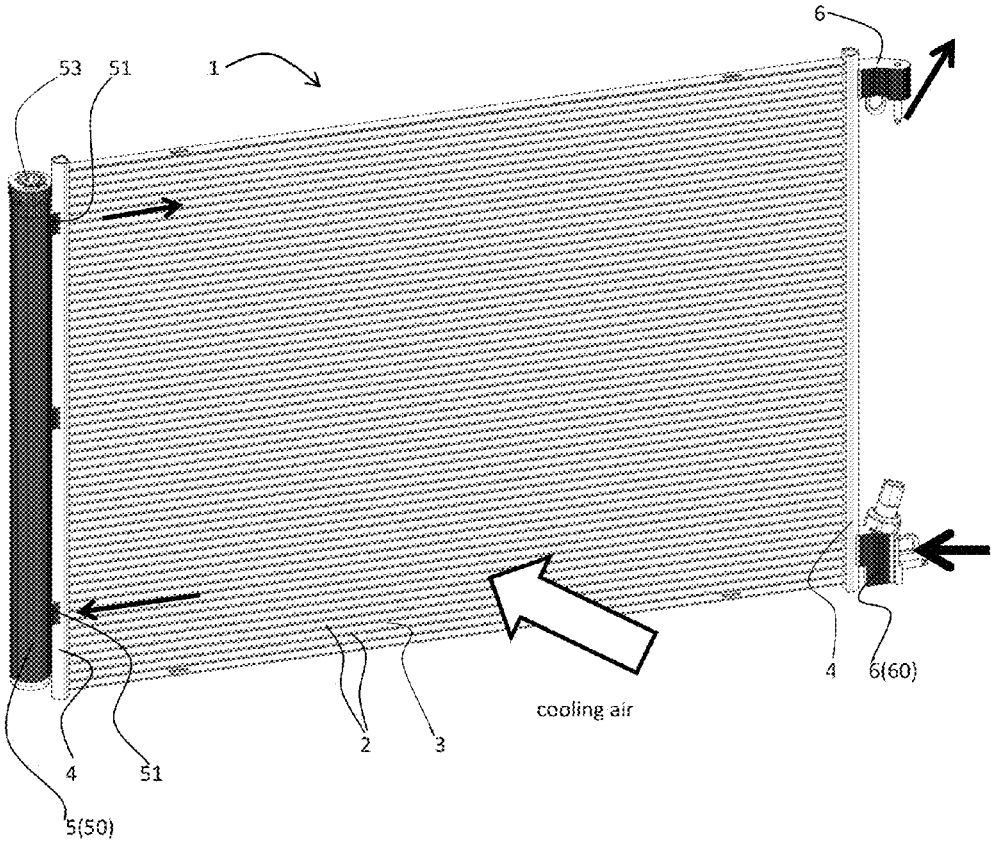
FIG. 1 shows a brazed heat exchanger (condenser) in a front view.

According to FIG. 1, the brazed heat exchanger, which, in the illustrative embodiment, is a condenser, has a block 1 consisting of flat tubes 2 and of fins 3 (not shown) between the flat tubes 2. Respective header tubes 4 are secured on opposite ends of the flat tubes 2. The header tube 4 on the left in the image is connected to an additional tube 5, which is arranged parallel thereto with a small spacing. Since, as mentioned, the heat exchanger in the illustrated embodiment is a condenser, the additional tube 5 is referred to below as a dryer cylinder 5.

The dryer cylinder 5 has projection-type connections 51 arranged on a straight line for implementing the connection discussed. In the connections 51, there are openings (not visible) (57, FIG. 5), to allow a refrigerant to enter the dryer cylinder 5 from the header tube 4 and to leave the dryer cylinder 5 via another connection 51.

According to FIG. 1, the visible outer surface 50 of the dryer cylinder 5 has been made of enlarged design.

Figure 2:
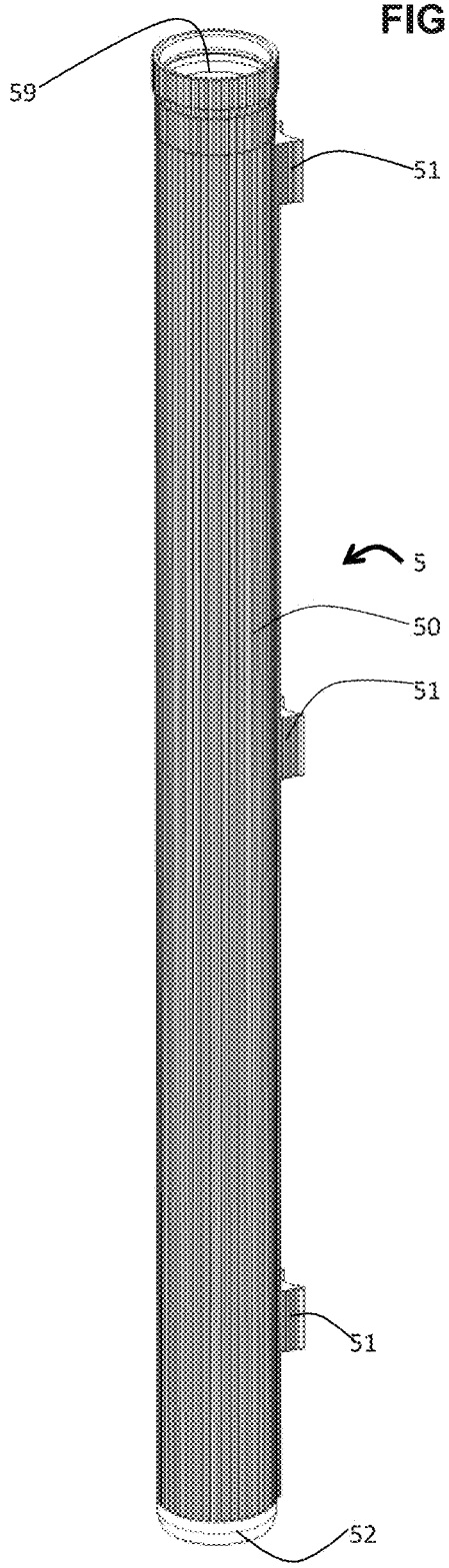
FIG. 2 shows an individual additional tube, also often referred to as a header tube, dryer cylinder, dryer tube or dryer/header.
Figure 3:
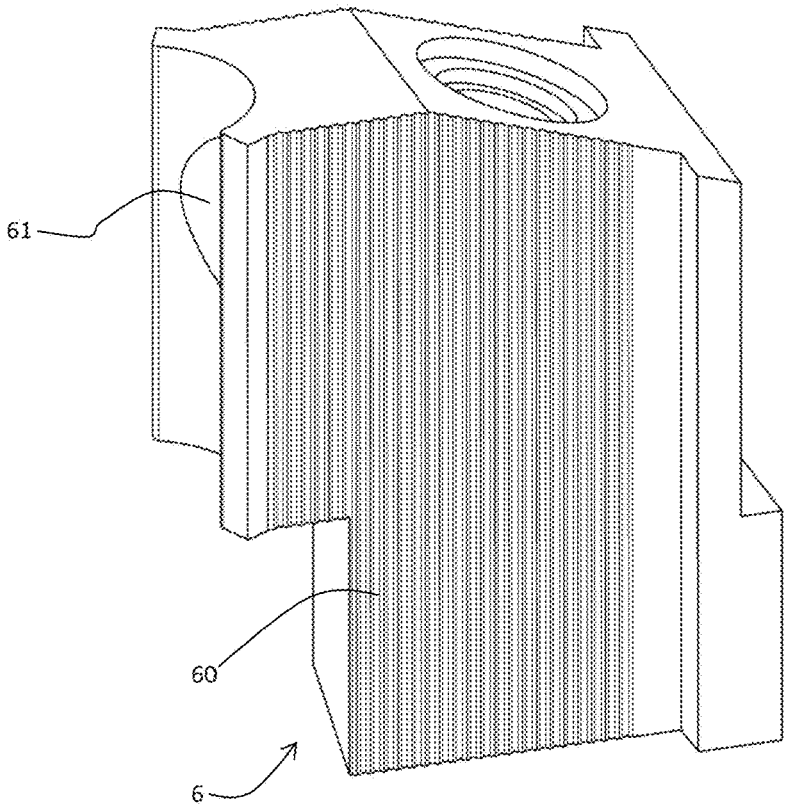
FIGS. 3 and 4 show connection elements, such as fittings or the like, which are arranged on the condenser.
Figure 4:
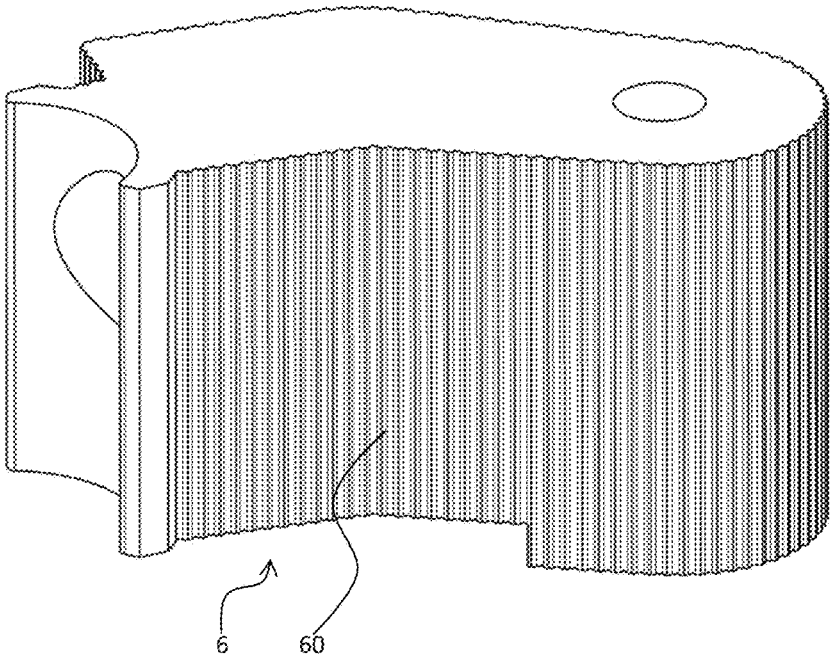

This heat exchanger also has, likewise brazed, fittings 6 or the like arranged on one of the header tubes 4—in FIG. 1 only on the right-hand header tube—for supplying and discharging the refrigerant, the outer surface 60 of which is of enlarged design. FIGS. 3 and 4 show the finished fittings 6 as individual parts. The surface structure 60 provided is clearly visible. The surface 50 of the dryer cylinder 5 is also designed in exactly the same way or in a similar way in this illustrative embodiment, although this is possibly not clearly apparent from FIGS. 1 and 2.

Figure 7:
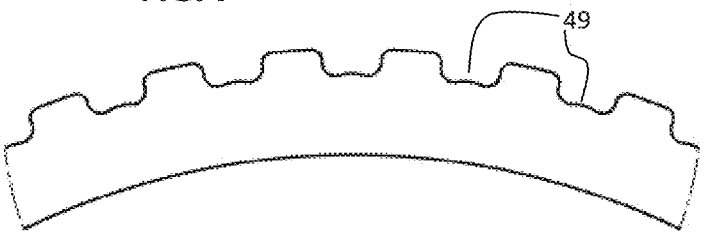
Figure 8:
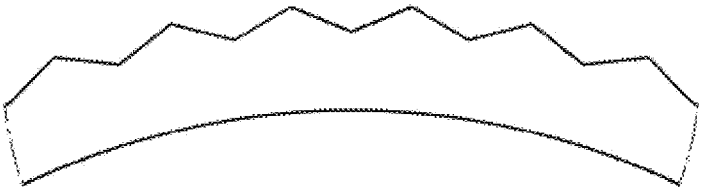
Figure 9:
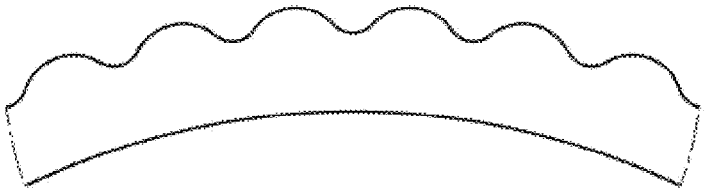

The surfaces 50, 60 have longitudinal grooves 49 (FIG. 7). The longitudinal grooves 49 are formed in the course of a production process for the dryer cylinder 5 and the fittings 6, e.g. by means of extrusion, this being known per se and therefore not illustrated in the drawing.

A larger cross section 61 can be seen on the lower fitting 6, which is also depicted in FIG. 3, and therefore it could be said that gaseous refrigerant enters the condenser there and then flows upward in stages or zigzag fashion through groups of flat tubes 2, being condensed by means of cooling air as it does so. The groups are formed by separating plates (not visible) in the header tubes 4. The refrigerant can enter the dryer cylinder 5 at the lower connection 51, for example. The refrigerant enters a supercooling section at the upper connection 51 and leaves the condenser as supercooled liquid at the upper fitting 6. The central connection 51 (FIG. 1) does not have an opening 57 in this illustrative embodiment.

In the dryer cylinder 5 there is a device, a dryer cage or the like, which is not visible in the drawings, containing a desiccant for refrigerant. In order to be able to replace the desiccant more easily when required but also in order to be able to more easily suppress bypasses on the inner surface of the dryer cylinder 5, it is advantageous if the inner surface 58 of the dryer cylinder remains smooth, i.e. does not have an enlarged surface.

The dryer cylinder 5 has been widened slightly at the upper end thereof (FIG. 2) in order to enable a plug to be inserted there, on which there rests a covering plate 53 made of plastic to prevent the ingress of dirt and moisture (FIG. 1). At the lower end of the dryer cylinder 5 there is an end plate 52 brazed in (FIG. 2).

Figure 5:
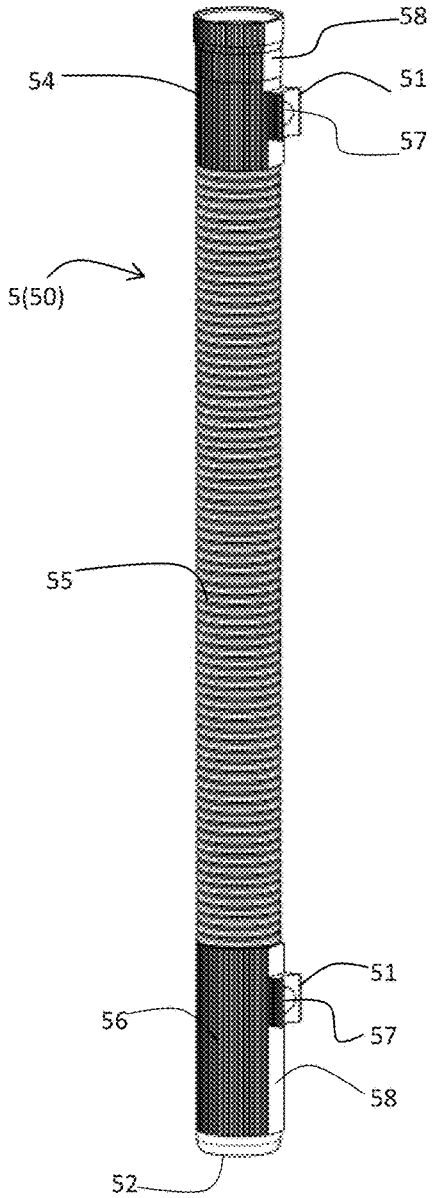
FIG. 5 shows another additional tube.
Figure 6:
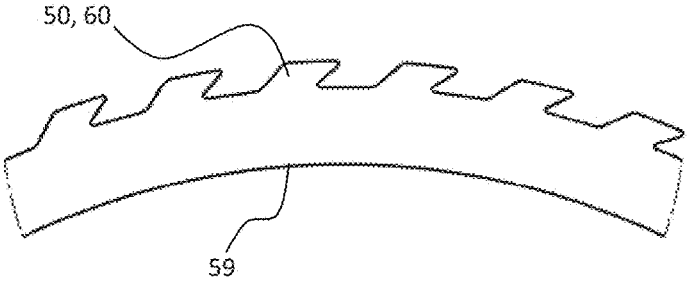
FIGS. 6 to 9 show various enlarged outer surfaces.

FIG. 5 shows a dryer cylinder 5, which is assembled from a plurality of parts 54, 55, 56. The lower and upper parts 54, 56 can be designed and produced identically or in a similar way to that in the case of the dryer cylinder 5 in FIG. 2. Since these parts are relatively small, both or at least one thereof could also be smooth, i.e. designed without an enlarged surface. The central, longer part 55 can be formed like a corrugated tube at the surface thereof, i.e. the grooves 49 in the surface can differ. According to FIG. 5, the profiling or grooves 49 are arranged in the central part 55 in the transverse direction of the tube. The ends of the parts may be machined, inserted one inside the other and brazed to one another.

An advantageous way of producing the connections 51 could also be explained with reference to FIGS. 5 and 2. As can be seen in FIG. 5, a straight strip 58, on which the connections 51 are situated, is not designed with an enlarged surface, i.e. is not grooved, for example. It can furthermore be seen from this that the dryer cylinder 5 from FIG. 2 and parts 54, 56 are produced as an extruded profile having a contiguous profile part corresponding approximately to the cross section of the connections 51. After this, some of the material of the profile part is removed in order to obtain the connections 51, which are formed from the remaining portions of the material of the profile part. After removal, the strip 58 that is visible in FIG. 5 remains. FIG. 5 also shows the already discussed openings 57 in the connections 51.

FIGS. 6 to 9 show enlarged (profiled) outer surfaces 50, 60 with differently shaped grooves 49 without claiming to be complete. Through trial or calculation, other or even more effective enlarged surface structures 50, 60 can possibly be determined.

Figure 10A:
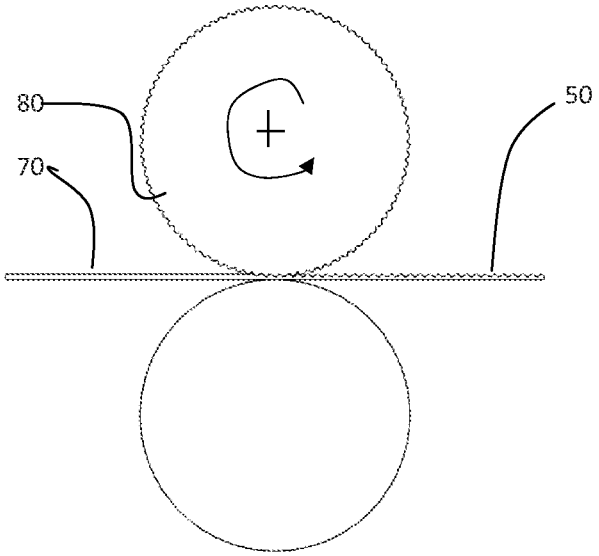
FIG. 10A shows an alternative tube production.
Figure 10B:
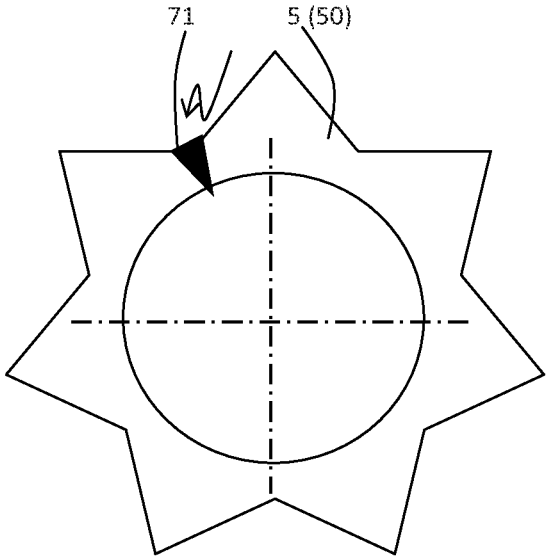
FIG. 10B shows an alternative tube production.

In FIG. 10A, there is a purely schematic illustration showing that the dryer cylinder 5 can also be produced from a sheet metal strip 70 as an alternative to extrusion. The surface 50 thereof is profiled and thereby enlarged by means of a rolling process 80. In this embodiment, the rolling process 80 is carried out before the production of the dryer tube shape. After the production of the tube shape, a longitudinal tube seam 71 is welded, FIG. 10B being intended to show this schematically.

What is claimed is:

1. A brazed heat exchanger, particularly a condenser, comprising:

a block including flat tubes, fins, and a first and a second header tube arranged at opposing ends of each of the flat tubes;

a dryer cylinder arranged parallel to, and spaced apart from, one of the first and second header tubes, wherein at least a portion of an outer surface of the dryer cylinder is profiled to provide an enlarged outer surface, wherein the dryer cylinder is formed as an extrusion, portions of the extrusion being subsequently removed to define the first and second projection-type connections and the planar outer surface;

a first and a second projection-type connection arranged on a straight line and integrally formed with the dryer cylinder, the first and second projection-type connections extending from a planar outer surface of the dryer cylinder across the spacing between the dryer cylinder and said one of the first and second headers;

a first opening extending through the first projection-type connection to allow refrigerant to enter the dryer cylinder from said one of the first and second headers; and a second opening extending through the second projection-type connection to allow refrigerant to return to said one of the first and second headers from the dryer cylinder.

2. The brazed heat exchanger of claim 1, wherein the outer surface of the dryer cylinder includes a grooved outer surface.

3. The brazed heat exchanger of claim 2, wherein the grooved outer surface includes grooves that extend in a straight line in a longitudinal direction.

4. The brazed heat exchange of claim 2, wherein the grooved outer surface includes grooves that extend in a coil in a longitudinal direction.

5. The brazed heat exchanger of claim 1, wherein an inner surface of the dryer cylinder is smooth.

6. The brazed heat exchanger of claim 1, wherein the first and second projection-type connections include a grooved surface.

7. The brazed heat exchanger of claim 1, further comprising fittings brazed to the other one of the first and second header tubes, the fittings configured to supply and discharge a refrigerant, wherein the fittings include an outer surface that is profiled.

8. The brazed heat exchanger of claim 1, wherein the dryer cylinder has a generally cylindrical shape with a smooth inner surface and an outer surface that is at least partially profiled to provide an enlarged outer surface.

9. The brazed heat exchanger of claim 1, wherein at least portions of the outer surfaces of the first and second projection-type connections are profiled to provide an enlarged outer surface.

10. The brazed heat exchanger of claim 1, further comprising at least one additional projection-type connection integrally formed with the dryer cylinder, the at least one additional projection-type connection extending across the spacing between the dryer cylinder and said one of the first and second headers.

11. The brazed heat exchanger of claim 10, wherein the at least one additional projection-type connection is arranged between the first and the second projection-type connections on the straight line.

12. A brazed heat exchanger, particularly a condenser, comprising:

a block including flat tubes, fins, and a first and a second header tube arranged at opposing ends of each of the flat tubes;

a dryer cylinder arranged parallel to, and spaced apart from, one of the first and second header tubes, wherein at least a portion of an outer surface of the dryer cylinder is profiled to provide an enlarged outer surface, wherein the dryer cylinder is formed as an extrusion and the planar outer surface is formed by machining away material of the extrusion on either side of each of the first and the second projection-type connections;

a first and a second projection-type connection arranged on a straight line and integrally formed with the dryer cylinder, the first and second projection-type connections extending from a planar outer surface of the dryer cylinder across the spacing between the dryer cylinder and said one of the first and second headers;

a first opening extending through the first projection-type connection to allow refrigerant to enter the dryer cylinder from said one of the first and second headers; and a second opening extending through the second projection-type connection to allow refrigerant to return to said one of the first and second headers from the dryer cylinder.

13. The brazed heat exchanger of claim 12, wherein the outer surface of the dryer cylinder includes a grooved outer surface.

14. The brazed heat exchanger of claim 13, wherein the grooved outer surface includes grooves that extend in a straight line in a longitudinal direction.

15. The brazed heat exchange of claim 13, wherein the grooved outer surface includes grooves that extend in a coil in a longitudinal direction.

16. The brazed heat exchanger of claim 13, wherein the grooved outer surface includes grooves that extend transversely to a longitudinal direction of the dryer cylinder.

17. The brazed heat exchanger of claim 12, further comprising fittings brazed to the other one of the first and second header tubes, the fittings configured to supply and discharge a refrigerant, wherein the fittings include an outer surface that is profiled.

18. The brazed heat exchanger of claim 12, wherein the dryer cylinder has a generally cylindrical shape with a smooth inner surface and an outer surface that is at least partially profiled to provide an enlarged outer surface.

19. The brazed heat exchanger of claim 12, further comprising at least one additional projection-type connection integrally formed with the dryer cylinder, the at least one additional projection-type connection extending across the spacing between the dryer cylinder and said one of the first and second headers, and wherein the at least one additional projection-type connection is arranged between the first and the second projection-type connections on the straight line.

* * * * *